US007815953B2

(12) United States Patent
Mastropasqua et al.

(10) Patent No.: US 7,815,953 B2
(45) Date of Patent: Oct. 19, 2010

(54) CAPSULES CONTAINING A SUBSTANCE IN POWDER FORM FROM WHICH A BEVERAGE, PREFERABLY ESPRESSO COFFEE, IS TO BE EXTRACTED

(75) Inventors: Luca Mastropasqua, Trieste (IT); Bruno Dellapietra, Duino Aurisina (IT); Frans Van Eeden, Milan (IT); Furio Suggi Liverani, Trieste (IT); Claudio Bolzicco, Pordenone (IT); Luigi Vozza, Trieste (IT)

(73) Assignee: Illycaffe' S.p.A. (IT)

( * ) Notice: Subject to any disclaimer, the term of this patent is extended or adjusted under 35 U.S.C. 154(b) by 651 days.

(21) Appl. No.: 11/640,696

(22) Filed: Dec. 18, 2006

(65) Prior Publication Data

US 2008/0026121 A1 Jan. 31, 2008

(30) Foreign Application Priority Data

Jul. 28, 2006 (IT) ..... MI2006A1503

(51) Int. Cl.
*A47J 31/40* (2006.01)

(52) U.S. Cl. ..... 426/77; 426/433; 426/80; 426/594; 99/295; 99/279; 99/323; 99/302 R

(58) Field of Classification Search ..... None
See application file for complete search history.

(56) References Cited

U.S. PATENT DOCUMENTS 5,008,013 A * 4/1991 Favre et al. ..... 210/482
5,813,317 A * 9/1998 Chang ..... 99/285
2002/0124753 A1* 9/2002 Hadden ..... 101/405
2007/0062375 A1* 3/2007 Liverani et al. ..... 99/279

FOREIGN PATENT DOCUMENTS

| | | |
|---|---|---|
| EP | 0 309 708 | 4/1989 |
| EP | 1 555 218 | 7/2005 |
| EP | 1 574 452 | 9/2005 |
| EP | 1 574 452 A | 9/2005 |
| EP | 1 580 144 | 9/2005 |
| EP | 1 580 144 A | 9/2005 |
| EP | 1580143 A1 * | 9/2005 |
| NL | 1 020 735 | 7/2002 |
| WO | 2004/083071 | 9/2004 |
| WO | WO 2004/083071 A | 9/2004 |

OTHER PUBLICATIONS

International Search Report; PCT/EP2006/011621; Mar. 30, 2007.
European Search Report—EP 09 17 7294.7-2308-Jan. 26, 2010.

* cited by examiner

*Primary Examiner*—Jennifer C McNeil
*Assistant Examiner*—Hong Mehta
(74) *Attorney, Agent, or Firm*—Cantor Colburn LLP

(57) ABSTRACT

A capsule for extracting a beverage from a substance in powder form, preferably ground coffee, by means of pressurized water, comprising a box-like body which contains the substance in powder form and has a base provided with an output port for the outflow of the extracted beverage, the output port being closed by an elastic crema forming septum which can open under the pressure of the water, the capsule further comprising a safety lid which is mounted on the box-like body at the base so as to increase the axial size of the box-like body, the lid comprising a shoulder which is engaged on the septum and is adapted to retain the septum within the capsule.

17 Claims, 3 Drawing Sheets

CAPSULES CONTAINING A SUBSTANCE IN POWDER FORM FROM WHICH A BEVERAGE, PREFERABLY ESPRESSO COFFEE, IS TO BE EXTRACTED

The present invention relates to improvements to capsules containing a substance in powder form from which a beverage, preferably espresso coffee, is to be extracted.

BACKGROUND OF THE INVENTION

It is known that machines for preparing espresso coffee, typically used in bars and restaurants, require a dose of roasted and ground coffee to be placed in an extraction chamber provided with a filtering container. This container may be part of the so-called filter basket holder, which is filled by hand with the dose of ground coffee (typically 7±1 g for each cup to be dispensed) and subsequently mounted on the machine in order to proceed with the extraction of the beverage.

Machines for preparing espresso coffee are provided internally with a boiler for heating the water drawn from a tank or other source and a pump for sending to the delivery duct hot water at a selected pressure.

The traditional method for extracting the beverage by means of known machines consists typically of a first preinfusion step, in which the flow-rate of water entering at 90±2° C. is reduced for a certain time interval; a second impregnation step; and a third extraction step, in which the coffee cake is crossed by a stream of hot water at 90±2° C. at a constant pressure of 9 bars at the input of the cake of powdered coffee.

The beverage obtained from traditional espresso coffee machines is usually clearly distinguishable from the beverage obtained at home with coffee pots or infusion devices not only because the properties of flavor, aroma and body are different but also because the beverage obtained from traditional espresso coffee machines is characterized by a surface layer of foam, also known as crema. Crema is an attribute of the coffee beverage which is particularly appreciated by the consumer and is an indicator of correct preparation of the beverage.

As disclosed in WO 2005/092160 and WO 2005/092162, the Applicant of the present patent application has designed a particular capsule which contains a substance in powder form, preferably roasted and ground coffee, the capsule being provided with an elastic septum which generates crema and by means of which it is possible to extract a beverage with improved physical and organoleptic characteristics.

The known elastic septum is fixed downstream of the dose of substance in powder form and of the corresponding filter sheet and is characterized by an elastic membrane which has at least one through orifice or gap provided in a central region, so as to open and allow the passage of the beverage only when the internal pressure exceeds a certain value.

A drawback observed in known capsules is linked to the length of the capsule manufacturing time. In the particular case of capsules provided with an elastic septum, some operations which slow down the manufacturing process are linked to the preparation, installation and fixing of the elastic septum within the capsule.

Another drawback is due to the fact that typically capsules which contain ground coffee use paper-based filters in order to retain the solid fractions within the capsule and prevent them from being poured into the cup. The choice of paper-based filters can entail limitations in the design of the capsule; for example, it forces to design the bottom of the capsule so that there are no regions in which the filter paper might break due to the pressure inside the capsule or due to surface unevenness or openings.

SUMMARY OF THE INVENTION

The aim of the present invention is to obviate the drawbacks of known capsules by providing improvements which allow a considerable reduction in the manufacturing times and costs of said capsule.

Within this aim, an object of the invention is to allow particularly quick and simple installation and fixing of the crema forming septum.

Another object of the invention is to provide a capsule which allows safe and reliable operation of the capsule throughout beverage extraction without losing in quality with respect to known capsules.

According to a first aspect of the invention, this aim and these and other objects, which will become better apparent hereinafter, are achieved by a capsule for extracting a beverage from a substance in powder form, preferably ground coffee, by means of pressurized water, comprising a box-like body which contains the substance in powder form, the box-like body having a base provided with an output port for the outflow of the extracted beverage, the output port being substantially closed by an elastic crema forming septum which can open under pressure, characterized in that it comprises a safety lid which is mounted on the box-like body at the base so as to increase the axial size of the box-like body, said lid comprising a shoulder which is engaged on the septum and is adapted to retain the septum within the capsule.

According to another aspect of the invention, the intended aim and objects are achieved by a flat filter for single-use capsules containing substances in powder form from which a beverage is to be extracted, characterized in that it is made of plastics and is adapted to retain the solid particles of-the beverage extracted from the capsule. The filter comprises a plurality of passages having a diameter of preferably 0.6 mm or less and if possible of at least 0.1 mm. The passages can be arranged on the filter with a spacing of at least 1.2 mm.

According to still another aspect of the invention, the intended aim and objects are achieved by a crema forming septum adapted to be installed downstream of a chamber which contains a substance in powder form, preferably ground coffee, for extracting a beverage by means of water under pressure, characterized in that it comprises an elastic membrane provided with a blind orifice which is adapted to be broken by the beverage during extraction.

The membrane is preferably made of thermoplastic elastomer (TPE), preferably SEBS and even more preferably Laprene® or of another material which allows the elastic membrane to be molded together with the plastic box-like body of the capsule in a single step of manufacture by means of co-molding, overmolding or coextrusion techniques. However, the membrane might also not be fixed directly to a capsule which contains the substance in powder form but might be fixed to an external support, installing it for example directly on the capsule holder of the beverage extraction machine.

BRIEF DESCRIPTION OF THE DRAWINGS

Further characteristics and advantages of the invention will become better apparent from the description of preferred but not exclusive embodiments thereof, illustrated by way of non-limiting example in the accompanying drawings, wherein.

In the following description, identical reference numerals designate elements which are identical or have an equivalent technical function.

DESCRIPTION OF THE PREFERRED EMBODIMENTS

Figure 1:
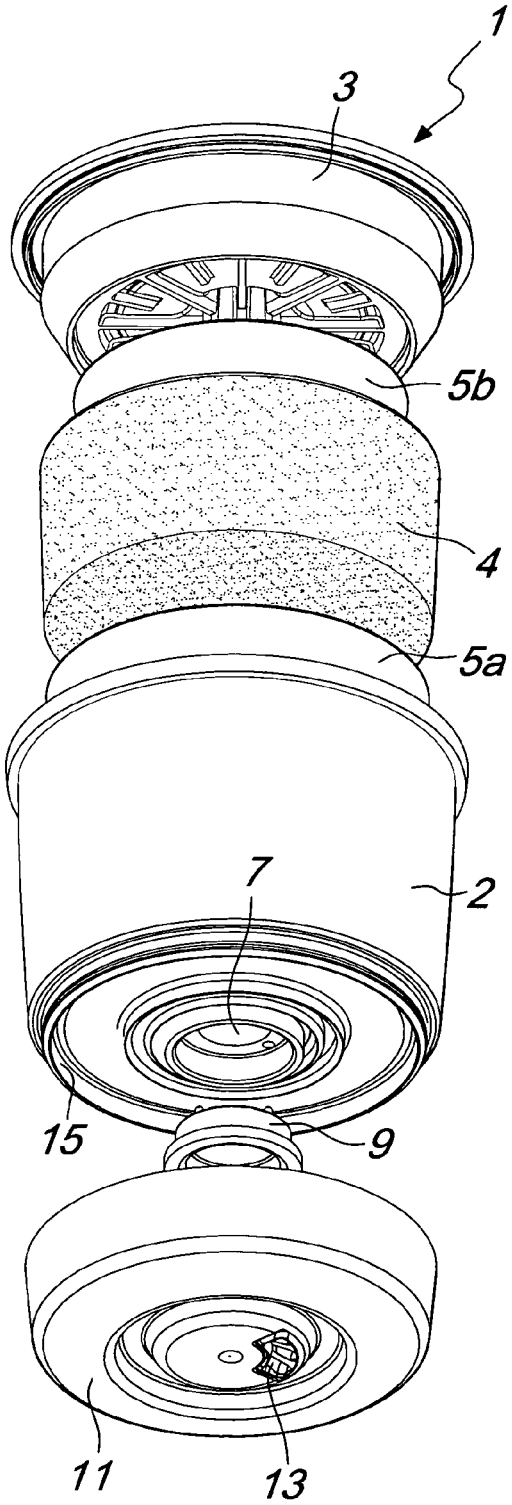
FIG. 1 is an exploded perspective view of the capsule according to a first embodiment of the invention.
Figure 2:
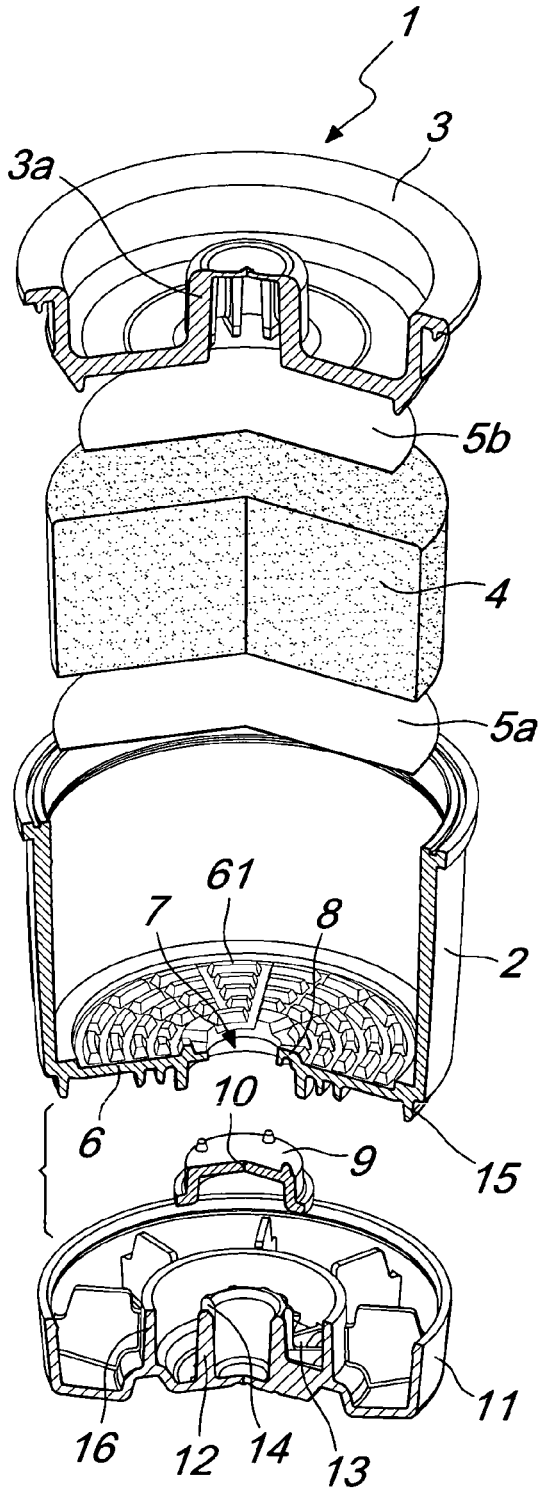
FIG. 2 is a sectional view of the exploded view of FIG. 1 from another viewpoint.
Figure 3:
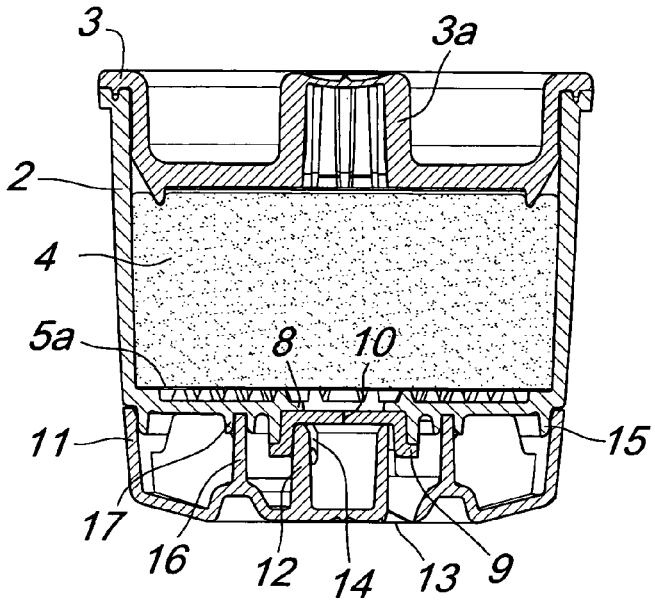
FIG. 3 is an axial sectional view of the capsule of FIGS. 1 and 2.

With reference to FIGS. 1 to 3, the capsule according to the invention, generally designated by the reference numeral 1, is substantially cylindrical (but it can also be frustum-shaped or prism-like) and comprises a box-like body which is formed preferably by two portions, i.e., a cup-shaped portion 2 and an element 3 for closing in an upward region the cup-shaped portion 2. The closure element 3 is provided with an input port 3a, which preferably but not necessarily protrudes and is closed and can be opened in a known manner by the beverage extraction machine by piercing in order to allow the inflow of hot water under pressure into the capsule. The cup 2 and the closure element 3 are welded together preferably by means of ultrasound or known similar techniques, as disclosed in prior WO 2005/092160 and WO 2005/092162.

The box-like body 2, 3 contains a substance in powder form 4, preferably ground coffee, which is suitable to allow the extraction of a beverage, for example espresso coffee, by means of water under pressure. The substance in powder form 4 can be comprised between two filtering elements 5*a* and 5*b*, which are adapted to retain the solid fractions, for example the granular coffee residues, within the capsule.

The box-like body of the capsule has a base 6 provided with an output port 7 for the out-flow of the extracted beverage. The base comprises preferably a plurality of ridges 61, which are adapted to define a narrow channel between the base and the lower filter 5*a* in order to convey the extracted beverage toward the output port 7.

The output port 7, arranged preferably in a central region of the base 6 and surrounded by a rim 8, is substantially closed by an elastic crema forming septum 9 which can open under pressure.

The septum 9 preferably comprises an elastic membrane made of elastomeric or rubber-like material, for example a TPE such as SEBS (a styrene-ethylene-butylene-styrene block copolymer) or Laprene® (based on SEBS and polyolefins).

The elastic membrane can comprise a through orifice 10, which is adapted to keep normally closed the septum 9 and therefore the beverage output port 7 when the capsule 1 is not used and is adapted to allow the beverage to pass when the pressure inside the capsule exceeds a certain value, for example 6 bars, causing a deformation and therefore a widening of the orifice 10.

As an alternative to the through orifice 10, the elastic membrane can comprise a blind orifice 110, which can be opened by breaking when the pressure in the capsule reaches a certain threshold, as discussed hereinafter with reference to FIG. 7.

The elastic septum 9 can be co-molded together with the box-like body 2, 3 of the capsule 1, which is preferably made of polypropylene, so as to eliminate intermediate mechanical operations for fixing the septum 9 to the rim 8 of the output port 7.

Figure 4:
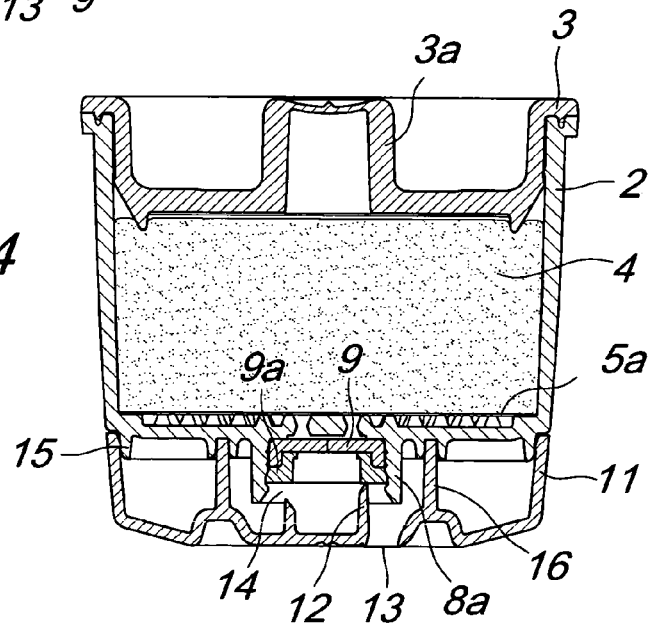
FIG. 4 is an axial sectional view of the capsule according to a second embodiment of the invention.
Figure 7:
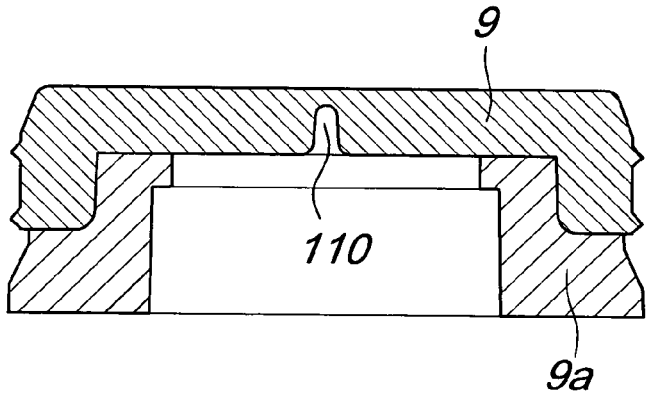
FIG. 7 is an axial sectional view of a septum according to a particular aspect of the invention.

As an alternative, the elastic membrane can be co-molded together with a rigid supporting ring 9*a*, such as the one shown in cross-section in FIGS. 7 and 4, which is adapted to be interlocked in a protruding cylindrical rim of the output port 7.

The capsule 1 further comprises a safety lid 11, which is mounted on the box-like body at the base 6 so as to increase the axial dimension of the box-like body. More specifically, the lid 11 is fixed to the box-like body of the capsule so as to protrude substantially from the base 6 substantially in the direction of the axis of symmetry of the capsule along the direction of the stream of water.

The lid 11 is preferably fixed mechanically to a peripheral rim 15 of the base 6, for example by snap action, so as to allow its quick fitting to the box-like body of the capsule 1.

The safety lid 11 is provided with a shoulder 12 which is engaged on the septum 9 and is adapted to retain the septum 9 against the output port 7 provided in the base 6, so as to prevent the septum from being accidentally expelled from the capsule due to the high pressures reached during beverage extraction. In the second embodiment of the capsule, shown in FIG. 4, the shoulder 12 engages the rigid annular support 9*a* of the septum, which is locked inside the protruding cylindrical rim 8*a* of the output port 7.

The shoulder 12 can have at least a passage 14 in order to allow the beverage to exit from the capsule 1 by passing through the safety lid 11. For this purpose, the lid 11 comprises at least an output opening 13, which in the particular embodiment of FIGS. 1 to 4 is laterally displaced with respect to the central axis of the output port 7 or with respect to the axis of symmetry of the capsule 1.

The passage 14 on the shoulder 12 and the output opening 13 of the lid 11 are arranged advantageously on opposite sides with respect to the central axis of the output port 7, thus forming a winding path for the extracted beverage, which reduces its speed.

Optionally, the lid 11 can be provided with a second closed cylindrical wall 16, which surrounds the shoulder 12 and can be interlocked within an appropriately provided circular seat 17 which is defined on the base 6 around the output port 7. The walls 12 and 16 thus define a cylindrical ring in which the beverage that exits from the orifice 10 of the septum 9 flows before reaching the output opening 13 provided in the safety lid 11.

Figure 5:
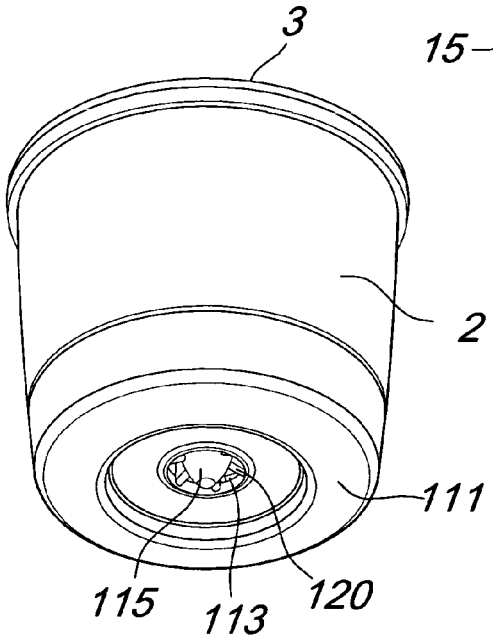
FIG. 5 is a bottom perspective view of the capsule according to a third embodiment of the invention.
Figure 6:
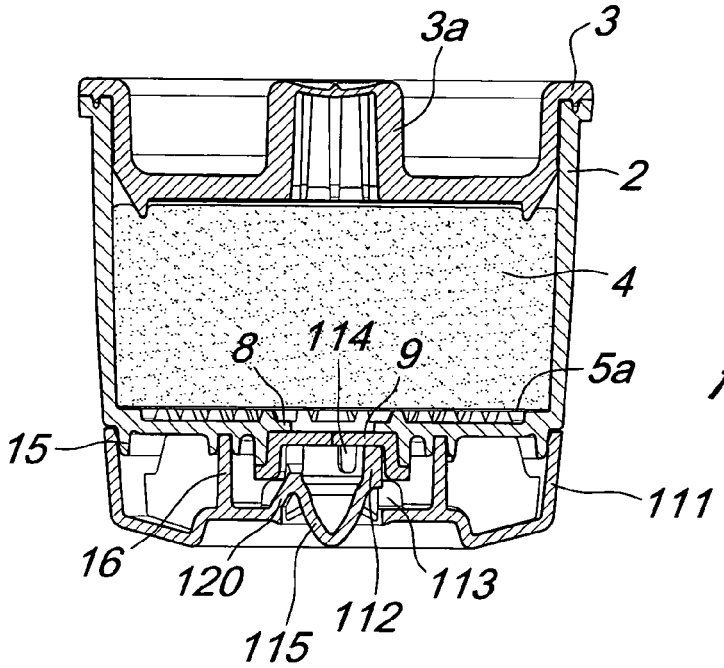
FIG. 6 is an axial sectional view of the capsule of FIG. 5.

As an alternative, as shown in FIGS. 5 and 6, the safety lid 111 used in a third embodiment of the invention can comprise an output opening 113 which is substantially annular and substantially coaxial to the output port 7 of the box-like body of the capsule and is adapted to allow the beverage to exit from the capsule in a direction which practically coincides with the axis of the capsule, differently from the embodiments of FIGS. 1-4, in which the flow is displaced laterally with respect to the axis.

The annular opening 113 is defined in a through hole of the lid 111 between the rim of the through hole and an ogive-shaped element 115, which is supported by the lid 111 by means of supporting arms 120 and is arranged in the through hole.

The ogive-shaped element is provided with a shoulder 112 which is similar to the shoulder 12 of FIGS. 1 to 4, i.e., it is engaged on the elastic septum 9 in order to retain the septum against the rim of the output port 7. In the capsule of FIGS. 5 and 6 also, the shoulder 112 is a partially open cylindrical wall, i.e., a wall provided with at least one passage 114.

As can be seen, the advantageous combination of a safety lid which is mounted so as to increase the axial dimension of the box-like body and of the shoulder in order to lock in its seat the elastic septum allows to ensure on the one hand the provision of a tool which is convenient and quick for the safety locking of the elastic septum within the capsule and on the other hand prevents the capsule from being used to extract a beverage if the safety means for retaining the septum within the capsule, i.e., the safety lid 11 or 111, is not present.

If the capsule 1 is in fact accidentally mounted without the safety lid 11 or 111 in a filter basket holder of a machine for extracting the beverage or espresso coffee, for example of the type disclosed in prior WO 2005/092162, the input port 3*a* of the capsule cannot be reached and/or pierced by the hot water injector of the machine, because it is too distant from the piercing needle. Therefore, in addition to simplifying and speeding up the capsule manufacturing operations, the invention allows advantageously to prevent the unintended use of a defective capsule, i.e. a capsule which is subject to the accidental expulsion of the elastic septum toward the cup or vessel in which the beverage is collected.

In the embodiments described so far, the elastic septum 9 is provided with an elastic membrane with a central through orifice 10. However, in order to simplify and speed up the manufacture of capsules which contain an elastic crema forming septum, the elastic membrane of the septum 9 can be molded so that it has a weaker region 110. The weaker region 110 is a prefracture region, i.e., a region which is adapted to be broken by the pressurized beverage during extraction. In this manner, the septum is formed completely in a single operation and does not require the additional piercing operations used for example in the manufacture of the septum of the capsules described in prior WO 2005/092160.

In the case shown in FIG. 7, the elastic membrane with a prefracture region 110 is applied to a rigid supporting ring 9*a*, to be used when the septum 9 is fixed mechanically to the cylindrical rim 8*a* of the output port (FIG. 4) by means of a snap engagement of the annular support 9*a* with an appropriately provided annular recess formed on-the inside of the cylindrical rim 8*a*.

However, as can be appreciated easily, the septum 9 with a prefracture region 110 can be molded together with the cup 2 of the capsule by co-molding, like the septum of the capsules shown in FIGS. 3 and 6. In this manner, by means of a single co-molding operation it is possible to manufacture a rigid box-like body which is already provided with an elastic crema forming septum without having to perform subsequent septum piercing operations.

Figure 8:
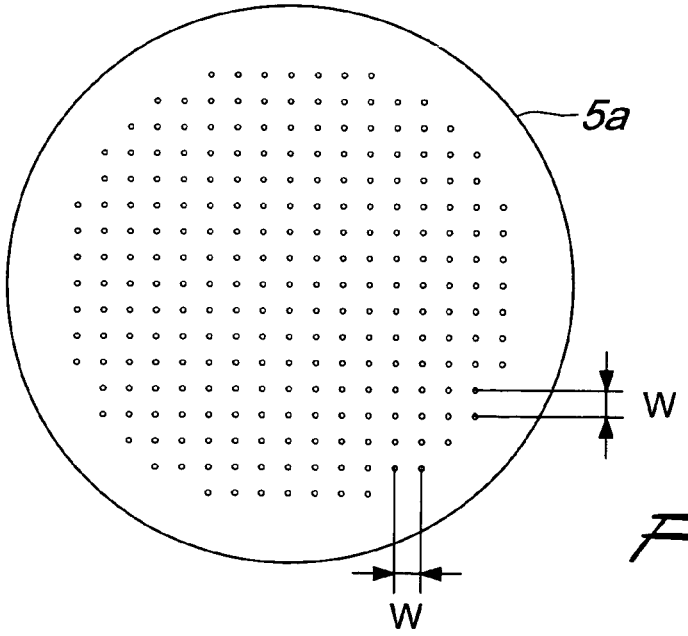
FIG. 8 is a plan view of a plastic filter according to a particular aspect of the invention.

With reference to FIG. 8, according to yet another aspect of the invention, the lower flat filter 5*a* of the capsule 1 is made of plastics and is adapted to retain the solid particles of the beverage extracted from the capsule with the same effectiveness as filter paper. The filter 5*a*, obtained by multiple piercing of a plastic sheet having a thickness from 0.5 to 2.5 mm, comprises a plurality of passages 55 having a diameter from 0.1 to 0.6 mm. The passages can be arranged on the filter 5*a* with a periodic spacing w of at least 1.2 mm in the two perpendicular directions.

The filter allows not only to speed up the manufacture of the capsule but also to eliminate the drawbacks that might arise from the use of paper-based filters. For example, with the plastic filter it is possible to provide even an output port 7 which has a considerable diameter without having to take into consideration the possibility of breakage of the lower filter due to excessive deformation, therefore without being limited to structures having small diameters of the output port or bridge-like supporting structures adapted to reduce the passage surface of the output port.

Moreover, the plastic filter can be made of the same material as the box-like body of the capsule, with considerable advantages in terms of production chain.

Of course, the plastic flat filter is not limited only to the capsules described here but can be used in any capsule containing substances in powder form for preparing beverages, particularly single-use capsules for preparing espresso coffee.

In practice it has been found that the invention fully achieves the intended aim, since it allows to reduce considerably the manufacturing times of single-use capsules for preparing beverages such as espresso coffee, eliminating some additional manufacturing steps which are separate from the molding of the capsule.

The installation and fixing of the crema forming septum is particularly quick and simple and at the same time allows safe and reliable operation of the capsule throughout the beverage extraction step.

Moreover, the invention allows to remove some technical limitations in the design of the capsule.

Although the invention has been conceived in particular for capsules suitable for preparing espresso coffee, it can in any case be used more generally for capsules which contain edible substances in general adapted to produce a beverage by percolation.

The capsule, the septum and the filter thus conceived are susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2006A001503 from which this application claims priority are incorporated herein by reference.

What is claimed is:

1. A capsule for extracting a beverage from a substance in powder form by means of pressurized water, comprising a containment body which contains said substance in powder form, the containment body having a cup-shaped portion, said cup-shaped portion comprising an external peripheral wall and a base provided with an internal output port for the outflow of the extracted beverage, said output port being closed by an elastic crema forming septum which can open under pressure, the capsule further comprising a safety lid which is mounted on said containment body at the base so as to increase the axial size of the containment body at said external peripheral wall of said cup-shaped portion, said lid comprising an internal shoulder which is engaged on the septum and is adapted to retain the septum within the capsule.

2. The capsule according to claim 1, wherein said safety lid is fixed to a peripheral rim of said base by snap engagement.

3. The capsule according to claim 1, wherein said safety lid comprises at least one output opening.

4. The capsule according to claim 3, wherein said at least one output opening is arranged on said lid in a position which is displaced laterally with respect to a central axis of the output port.

5. The capsule according to claim 3, wherein said at least one opening is annular and coaxial to said output port.

6. The capsule according to claim 5, wherein said annular opening is defined in a through hole of said safety lid between an ogive-shaped element arranged in said through hole and the rim of said through hole, said ogive-shaped element being supported by said lid by means of supporting arms.

7. The capsule according to claim 1, wherein the elastic septum which can open under pressure comprises an elastic membrane which has a through orifice provided beforehand in the membrane or a weaker region which is adapted to be broken under pressure during beverage extraction.

8. The capsule according to claim 7, wherein said weaker region comprises a region which is a blind orifice thinner than said membrane.

9. The capsule according to claim 1, wherein said containment body is made of plastic material, and the elastic septum comprises a thermoplastic elastomer which is co-molded with said containment body at the rim of said output port.

10. The capsule according to claim 1, wherein said output port comprises a cylindrical rim which protrudes axially from said base toward the outside of the containment body, the elastic septum being fixed mechanically to the internal surface of said cylindrical rim.

11. The capsule according to claim 1, further comprising a plastic flat filter which is arranged inside said containment body, between the substance in powder form and the output port, said filter being adapted to prevent the passage of solid fractions of the beverage through the output port.

12. The capsule according to claim 11, wherein the plastic filter comprises a plurality of passages whose diameter is at most 0.6 mm.

13. The capsule according to claim 12, wherein the diameter of each of the passages is at least 0.1 mm.

14. The capsule according to claim 12, wherein the passages are arranged on said-filter with a spacing of at least 1.2 mm.

15. The capsule according to claim 11, wherein said filter has a thickness from 0.5 to 2.5 mm.

16. A crema forming septum, adapted to be installed downstream of a chamber which contains a substance in powder form for extracting a beverage by means of pressurized water, the septum comprising an elastic membrane which has a weaker region adapted to be broken by the pressurized beverage during extraction, said weaker region being a prefracture blind orifice having a thickness that is thinner than regions of said membrane adjacent said prefracture blind orifice.

17. The septum according to claim 16, wherein said membrane is made of thermoplastic elastomer.

* * * * *